US010462587B2

(12) United States Patent
Barth et al.

(10) Patent No.: US 10,462,587 B2
(45) Date of Patent: Oct. 29, 2019

(54) CONNECTOR FOR A HEARING INSTRUMENT AND HEARING INSTRUMENT

(75) Inventors: Joachim Roland Barth, Nuremberg (DE); Holger Kral, Fuerth (DE); Frank Naumann, Erlangen (DE); Andreas Ratay, Erlangen (DE); Markus Trautner, Neuendettelsau (DE)

(73) Assignee: Sivantos Pte. Ltd., Singapore (SG)

( * ) Notice: Subject to any disclaimer, the term of this patent is extended or adjusted under 35 U.S.C. 154(b) by 464 days.

(21) Appl. No.: 13/580,435

(22) PCT Filed: Apr. 27, 2010

(86) PCT No.: PCT/EP2010/055604
§ 371 (c)(1),
(2), (4) Date: Aug. 22, 2012

(87) PCT Pub. No.: WO2011/101041
PCT Pub. Date: Aug. 25, 2011

(65) Prior Publication Data

US 2013/0004005 A1 Jan. 3, 2013

Related U.S. Application Data

(60) Provisional application No. 61/319,921, filed on Apr. 1, 2010.

(30) Foreign Application Priority Data

Feb. 22, 2010 (DE) ..... 10 2010 008 871

(51) Int. Cl.
*H04R 25/00* (2006.01)
*H01R 13/24* (2006.01)
(Continued)

(52) U.S. Cl.
CPC ..... *H04R 25/556* (2013.01); *H01R 13/2471* (2013.01); *H01R 13/5219* (2013.01);
(Continued)

(58) Field of Classification Search
CPC ..... H04R 25/60; H04R 25/556; H04R 2225/021; H04R 2225/0213
(Continued)

(56) References Cited

U.S. PATENT DOCUMENTS 2,999,136 A * 9/1961 Holt ..... G02C 11/06 351/119
3,045,073 A 7/1962 Vickerson
(Continued)

FOREIGN PATENT DOCUMENTS

CH 668154 A5 11/1988
CH 673 551 A5 3/1990
(Continued)

OTHER PUBLICATIONS

Audiologyonline, "Oticon Delta Combines Groundbreaking Form & Function to Attract the Next Generation of Hearing Aid Users", Apr. 7, 2006, http://www.audiologyonline.com/realeases/oticon-delta-combines-graoundbreaking-form-4851, pp. 1-3.
(Continued)

*Primary Examiner* — Matthew A Eason
(74) *Attorney, Agent, or Firm* — Laurence A. Greenberg; Werner H. Stemer; Ralph E. Locher

(57) ABSTRACT

A connector for a hearing instrument, in particular a receiver-in-canal behind-the-ear hearing aid, is small and visually inconspicuous. The connector should be as invisible as possible on the hearing instrument as it is worn, and the connector allows a microphone arrangement favorable for directionality and sound pick-up. The connector is disposed on an earpiece tube, which defines a longitudinal direction
(Continued)

at the connector. The connector is connected by insertion into a connector receptacle of a hearing instrument transversely to the longitudinal direction. The hearing instrument has a laterally arranged connector receptacle, into which a connector is inserted transversely to the longitudinal direction. Because of the transverse insertion, the connector can be arranged laterally on the housing and because of the lateral placement, the front end face of the housing is smaller and the housing is overall flatter. A microphone can be arranged on the end face instead of the connector so as to improve sound pick-up and directionality.

11 Claims, 4 Drawing Sheets

(51) Int. Cl.
*H01R 13/52* (2006.01)
*H01R 13/56* (2006.01)
*H01R 13/639* (2006.01)

(52) U.S. Cl.
CPC ..... *H01R 13/567* (2013.01); *H01R 13/639* (2013.01); *H01R 2201/12* (2013.01)

(58) Field of Classification Search
USPC ..... 381/330, 328, 300
See application file for complete search history.

(56) References Cited

U.S. PATENT DOCUMENTS 3,119,903 A 1/1964 Rosemond et al.
4,592,370 A * 6/1986 Lee et al. ..... 600/379
5,404,407 A 4/1995 Weiss
5,500,901 A 3/1996 Geraci et al.
5,987,146 A * 11/1999 Pluvinage et al. ..... 381/328
6,319,020 B1 11/2001 Brimhall et al.
7,016,512 B1 3/2006 Feeley et al.
7,110,562 B1 * 9/2006 Feeley ..... H04R 25/60 381/322
7,606,382 B2 10/2009 Feeley et al.
7,715,580 B2 5/2010 Nielsen
7,715,582 B2 * 5/2010 Ochsenbein ..... H04R 25/60 381/330
8,238,594 B2 8/2012 Sauer et al.
8,311,252 B2 * 11/2012 Dittli ..... H04R 25/456 381/324
8,442,253 B2 * 5/2013 Finlay ..... H04R 25/00 381/328
8,638,965 B2 * 1/2014 Higgins ..... H01R 13/22 381/330
8,867,769 B2 * 10/2014 Naumann ..... H04R 25/60 381/330
9,247,360 B2 * 1/2016 Barth ..... G10K 11/22
9,654,886 B2 * 5/2017 Barth ..... H04R 25/556
10,038,960 B2 * 7/2018 Beyfuss ..... G10K 11/22
10,306,384 B2 * 5/2019 Larsen ..... H04R 25/604
2003/0002700 A1 * 1/2003 Fretz ..... H04R 25/65 381/330
2007/0081686 A1 * 4/2007 Sluppke ..... H04R 25/60 381/330
2007/0183612 A1 * 8/2007 Ochsenbein ..... H04R 25/60 381/322
2008/0253598 A1 * 10/2008 Nielsen ..... H04R 25/65 381/330
2008/0273733 A1 11/2008 Bauman et al.
2009/0182688 A1 * 7/2009 van der Zwan ..... G02C 11/06 705/500
2009/0245525 A1 * 10/2009 Zhang ..... H04R 19/04 381/60
2009/0304216 A1 * 12/2009 Hansen ..... H04R 25/604 381/324
2013/0230197 A1 * 9/2013 Higgins ..... H01R 13/2414 381/315

FOREIGN PATENT DOCUMENTS

DE 10 2008 022 925 A1 6/2009
DE 102008055919 A1 12/2009
EP 0 591 791 A1 4/1994
EP 1816894 A1 8/2007
EP 2040343 A1 3/2009
EP 2068587 A2 6/2009
JP H1198599 A 4/1999
WO 0143236 A1 6/2001
WO 2007107154 A1 9/2007
WO 2008015295 A2 2/2008
WO 2008095489 A1 8/2008
WO 2008095505 A1 8/2008

OTHER PUBLICATIONS

Opticon—Delta: "Delta Success Manual—The Complete Guide to Delta Fitting and Operations", by Opticon, Nov. 2006.
Med-El :"Actualites Med-El" by Vibrant Med-El Hearing Technology, published Nov. 2008, Nww.medel.com.

* cited by examiner

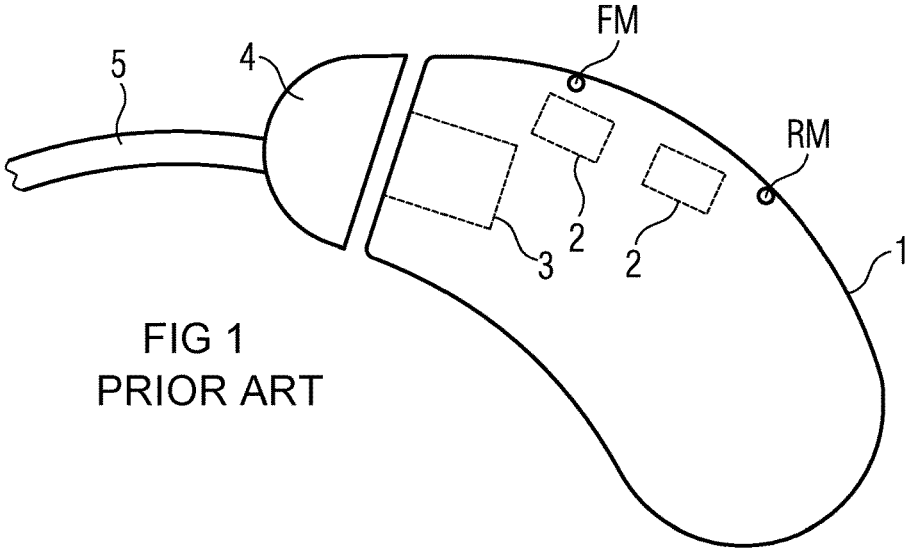
FIG 1
PRIOR ART
FIG 2
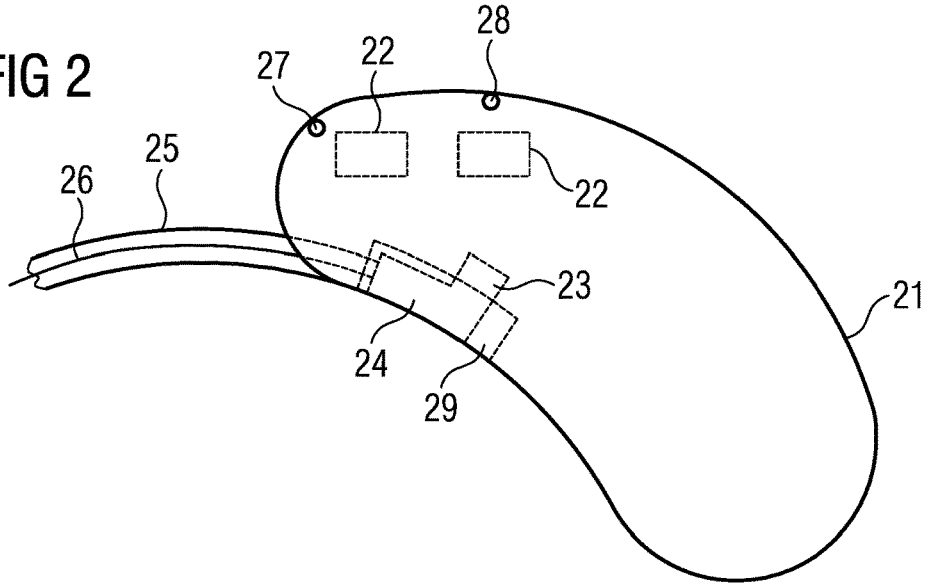
FIG 3
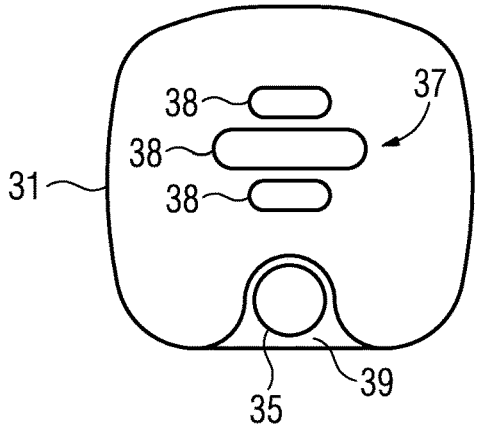

CONNECTOR FOR A HEARING INSTRUMENT AND HEARING INSTRUMENT

BACKGROUND OF THE INVENTION

Field of the Invention

The invention relates to a connector for a hearing instrument, in particular a hearing aid that can be worn on a hearing-aid wearer's head, especially an RIC-BTE (Receiver-In-Canal; Behind-The-Ear) hearing aid.

Hearing instruments can be embodied as hearing aids. A hearing aid serves to supply a hearing-impaired person with acoustic ambient signals that have been processed and amplified for compensating or, as the case may be, treating the relevant hearing impairment. It consists basically of one or more source transducers, a signal-processing device, an amplification device, and an output transducer. The source transducer is as a rule a sound receiver, for example a microphone, and/or an electromagnetic receiver, for example an induction coil. The output-signal generator is as a rule realized as an electroacoustic transducer, for example a miniature loudspeaker, or as an electromechanical transducer, for example a bone-conduction vibrator. It is referred to also as a hearing device or receiver. The output-signal generator generates output signals that are ducted to the patient's ear and are intended to produce a perception of hearing in the patient. The amplifier is as a rule integrated in the signal-processing device. The hearing aid is powered by a battery integrated in the hearing-aid's housing. The main components of a hearing aid are as a rule arranged on a printed circuit board as a substrate or, as the case may be, are connected thereto.

Apart from as a hearing aid serving to compensate a diminished sense of hearing, referred to usually as hardness of hearing, hearing instruments can also be embodied as what are termed tinnitus maskers. Tinnitus maskers are used in the treatment of tinnitus sufferers. They generate acoustic output signals that are dependent on the relevant hearing impairment and, depending on the specific operating principle, also on ambient sounds, and which can help reduce the perception of annoying tinnitus sounds and other sounds in the ears. The term "hearing instrument" as used below is meant also to include tinnitus maskers and other such devices.

Hearing aids are known in various basic housing configurations. In the case of ITE (In-The-Ear) hearing aids a housing that contains all the functional components including a microphone and receiver is worn for the most part in the auditory canal. CIC (Completely-In-Canal) hearing aids are similar to ITE hearing aids but are worn completely in the auditory canal. In the case of BTE (Behind-The-Ear) hearing aids a housing containing components such as a battery and signal-processing device is worn behind the ear and a flexible acoustic tube ducts a receiver's acoustic output signals from the housing to the auditory canal. RIC-BTE (Receiver-In-Canal; Behind-The-Ear) hearing aids are similar to BTE hearing aids, but the receiver is worn in the auditory canal and instead of an acoustic tube a flexible earpiece tube ducts electric instead of acoustic signals to the receiver which is attached to the front of the earpiece tube. An objective common to all housing configurations is to make housings as small as possible in order both to enhance comfort for the wearer and to reduce the hearing aid's visibility for cosmetic reasons.

RIC-BTE hearing aids can be fitted with a plurality of microphones to enable the ambient sound registered by the microphones to be spatially resolved. The term used is "directionality". To make directionality possible, the plurality of microphones are arranged mutually apart. It is obvious that the microphones' spatial arrangement relative to each other and to the hearing-aid wearer's ear will affect the spatial resolution.

The housing and earpiece tube of RIC-BTE hearing aids are as a rule detachably joined to each other. Provided for that purpose is a connector which as a rule is designed for plugging in. The connector comprises at least one electric connecting component, for example a pin connector, by means of which the electric connection is established between the electric components located inside the hearing aid's housing and the receiver located on the earpiece tube.

FIG. 1 shows a conventional RIC-BTE hearing aid according to the above-described prior art, but not having a receiver. It comprises a housing 1 to be worn behind a hearing-aid wearer's pinna. Located inside the housing alongside other electronic components that are not shown are two microphones 2. One of microphones 2 is located further forward and so is referred to also as front microphone FM; the other microphone 2 is located further back and so is referred to also as rear microphone RM.

The housing includes a socket 3 for establishing the electric connection to a receiver. Socket 3 forms part of a connector receptacle by means of which an earpiece tube 5 can be detachably connected via connector 4 to housing 1 and to the electronic components located therein. The connector is located on the front end wall of oblong housing 1. Said end wall of housing 1 projects—when the housing is being worn behind a hearing-aid wearer's ear as intended—toward the pinna's top front edge and possibly also beyond it, meaning that it may be visible when viewed from the front and possibly also from the side. Attached to the other end—not shown—of earpiece tube 5 is a receiver—not shown either—which is worn in the hearing-aid wearer's auditory canal.

What, among other things, is disadvantageous about the above-described, already known RIC-BTE hearing aid is that connector 4 is very conspicuous and, from an esthetic and cosmetic view-point, visually not very pleasing owing to its exposed location at the front of housing 1 and also because of its size. It is also disadvantageous that the front end wall of housing 1 cannot be made much smaller owing to connector 4 or, as the case may be, the connector receptacle. A further disadvantage is that microphones 2, which are located behind connector 4, are both so far back on housing 1 that they may possibly be partially obscured by the hearing-aid wearer's ear or its pinna, which will impede the registering of acoustic ambient signals. It is furthermore disadvantageous that, following the pinna's contours, microphones 2 are located at different heights, rear microphone 2 being specifically located below front microphone 2, whereas it would be more favorable for directionality or, as the case may be, the directionality index if they were located at the same height.

The terms "at the front", "at the rear", "above", and "below" are each understood in the foregoing and henceforth as proceeding from the hearing-aid housing being worn behind the ear. Thus "at the front" refers to an orientation in the hearing-aid wearer's viewing direction and "below" to an orientation in the vertical downward direction and hence, approaching from above, toward the hearing-aid wearer's ear.

Already known hearing aids usually comprise an inner frame in which components are secured and mounted and an outer housing. The housing is frequently mounted in an exchangeable manner and can be replaced to create a new design in terms of the hearing aid's color and shape. However, the connector customarily used in known hearing aids limits the scope for creating new designs in terms of color and shape because unlike the housing it is a functional component of the hearing aid in that it has to establish a mechanical and possibly electric and/or possibly acoustic connection between the housing and the earpiece tube or another component requiring to be connected.

BRIEF SUMMARY OF THE INVENTION

The object of the invention is to disclose a small and visually inconspicuous connector for a hearing instrument, the aim being for the connector to be as little visible as possible or even not at all on the hearing instrument when being worn, and which connector will make a microphone arrangement possible that is favorable for directionality and sound registering when used on a BTE hearing aid.

The invention achieves said object by means of a connector and a hearing instrument having features of the independent claims.

A basic idea of the invention as regards the connector consists in a connector for a hearing instrument, which connector comprises an electric connecting component and a mechanical connecting component. The electric connecting component can be brought into mutual engagement with an electric connecting element inside a housing of a hearing instrument and the mechanical connecting component can be brought into mutual engagement with a mechanical connecting element forming a constituent part of the hearing instrument's housing. That is because the connector is located on an earpiece tube and is embodied for connecting the earpiece tube to a housing of a hearing instrument, in particular a BTE hearing aid. A longitudinal direction is defined in the region of the connector by the earpiece tube and the connector is embodied such that by being placed in a connector receptacle of a hearing instrument it will be connected transversely to the longitudinal direction.

Because the connector is connected transversely to the longitudinal direction and not, through being plugged into position, in the longitudinal direction, it can be connected to a connector receptacle arranged laterally on a housing of a hearing instrument. That allows more flexible positioning, particularly on a side wall of the housing, which is advantageous specifically in the case of a BTE hearing aid. Through being connected transversely to the longitudinal direction the connector's link is moreover protected against straining from tensile loading in the longitudinal direction due, for instance, to pulling on the earpiece tube.

In an advantageous development a sealing means, particularly a sealing ring, is provided in the mechanical connecting compovent. The sealing means will protect the hearing instrument and connector or, as the case may be, the electric contacts of the connector against the ingress of dirt and moisture. Corrosion will be reduced thereby and difficulties with contacting lessened. Locating the connector laterally on a housing will therein make a level sealing area possible against which the sealing means is to be applied, whereas only small areas and mainly bent surfaces are available in the case of conventional locating on an end wall.

In another advantageous development the connector's mechanical connecting component comprises a retaining collar and an elastic deadbolt that can both be brought into mutual engagement with undercuts in a housing of a hearing instrument. For example the retaining collar can be inserted or placed into one undercut while the elastic deadbolt can automatically snap into the other undercut under the application of pressure. The result is a particularly easy-to-manage closing mechanism. Locating the connector link laterally on a housing advantageously means that more of the housing's area will be available for providing the retaining and closing means than on a smaller end wall of the housing. The connector link can be closed by being manually snapped into place with no need for an additional tool; opening requires only a generally available standard tool such as a screwdriver.

In another advantageous development the connector's mechanical connecting component comprises a locking-pin receptacle. Said receptacle is oriented such that the connector can be locked by inserting a locking pin into the locking-pin receptacle and unlocked by removing the locking pin. The locking-pin receptacle is for that purpose oriented preferably transversely to the direction in which the connector is inserted into and removed from the connector receptacle. The locking-pin receptacle can in the simplest case be a round drilled hole into which a likewise round pin can be inserted; the hole and pin can be dimensioned such that the pin is seated in the hole "under suction" and so will not slip out of the receptacle spontaneously but instead can be extracted only by being pushed or pulled. The connector link can be closed by pushing the pin in manually with no need for an additional tool; opening requires only a generally available standard implement such as any slim pointed object.

In another advantageous development the connector's electric connecting component comprises a contact pin to which an elastic force is applied, in particular a pogo pin. An always secure electric connection will be achieved owing to the elastic force. The elastic force can therein particularly increase the pressure being exerted on the electric connection, thereby making for better contact and thus also compensating possible mechanical play due, for example, to the connector's or convector receptacle's tolerances. Applying an elastic force to the electric connection will thus increase reliability and reduce the requirements placed on mechanical manufacturing accuracy.

A basic idea of the invention as regards a hearing instrument consists in a hearing instrument, in particular an RIC-BTE hearing aid, having a housing and a connector receptacle. A longitudinal direction is defined by the housing and the connector receptacle opens in a direction that is transverse to the longitudinal direction such that a connector will be connected by being inserted into the connector receptacle transversely to the longitudinal direction.

Because the connector is connected transversely to the longitudinal direction and not, through being plugged into position, in the longitudinal direction, it can be connected to a connector receptacle arranged laterally on a housing of a hearing instrument. That will allow more flexible positioning, particularly on a side wall of the housing, which is advantageous specifically in the case of a BTE hearing aid. On the one hand the housing's end wall can consequently be made smaller, which is visually advantageous because specifically an RIC-BTE hearing aid's end wall projects visibly from the front beyond the hearing-aid wearer's ear. The freed-up part of the end wall can furthermore advantageously be put to another use, particularly in the case of an RIC-BTE hearing aid to locate a microphone further forward in the region of the end wall, the result of which will be better sound registering and a more favorable location for directional microphone arrangements. The connector link will enable the hearing aid to have a narrow front area and is visually inconspicuous and discrete. Overall, it will also make a slim hearing aid possible having a slender and compact design. Through being connected transversely to the longitudinal direction the connector's link will moreover be protected against straining from tensile loading in the longitudinal direction due, for instance, to pulling on the earpiece tube.

In an advantageous development the hearing instrument's convection receptacle comprises an electric connecting component and a mechanical connecting component. The electric connecting component includes an electric connecting element located inside the hearing instrument's housing and the mechanical connecting component includes a mechanical connecting element forming a constituent part of the housing. The electric connecting component is thereby advantageously separated from the mechanical connecting component. The electric connecting component can, for instance, be based on a force-fit contact, for example with a spring being used, and be realized as, for example, a pogo pin (a pin contact to which an elastic force is applied). It can, for example, contact the hearing aid's inner frame or, as the case may be, an electric plug component connected to the inner frame. The mechanical connecting compovent, which can serve also as a lock and in which sealing means can also have been integrated or provided, engages with the hearing aid's outer housing. A lock can therein have been realized in the form of, for example, a snap lock or by means of a pivot or, as the case may be, pin.

A connector link of such kind facilitates handling and makes closing and opening easy. It requires little space and makes it possible to manage with a reduced extent of a double-wall embodiment of outer housing and inner frame. If the connector link's mechanical component on the hearing-instrument side is damaged it can be replaced along with the hearing-instrument housing, which is advantageous during servicing. There is no need for a separate connector component in addition to the housing because of the housing's double function as a housing and a mechanical component of the connector link.

A connector link of such kind advantageously makes a hearing aid possible having a housing that is to be worn behind a hearing-aid wearer's ear and located in which are a connector receptacle for establishing a connection to an earpiece tube and at least two microphones each connected to a microphone opening, with the microphone openings being situated at spatially separated microphone locations, and with the plug-in connector being located on a side wall of the housing and one of the microphone locations being situated in the region of a front end wall of the housing.

In another advantageous embodiment the hearing instrument's mechanical connecting component comprises undercuts on the housing, which undercuts can be brought into mutual engagement with a retaining collar and an elastic deadbolt of a connector. For example the retaining collar can be inserted or placed into one undercut while the elastic deadbolt can automatically snap into the other undercut under the application of pressure. The result is a particularly easy-to-manage closing mechanism. Locating the connector link laterally on a housing advantageously means that more of the housing's area will be available for providing the retaining and closing means than on a smaller end wall of the housing. The connector link can be closed by being manually snapped into place with no need for an additional tool; opening requires only a generally available standard tool such as a screwdriver.

In another advantageous embodiment the hearing instrument's mechanical connecting component comprises a locking-pin receptacle on the housing. Said receptacle is oriented such that a connector can be locked by inserting a locking pin into the locking-pin receptacle and unlocked by removing the locking pin. The locking-pin receptacle is for that purpose oriented preferably transversely to the direction in which the connector is inserted into and removed from the connector receptacle. The locking-pin receptacle can in the simplest case be a round drilled hole into which a likewise round pin can be inserted; the hole and pin can be dimensioned such that the pin is seated in the hole "under suction" and so will not slip out of the receptacle spontaneously but instead can be extracted only by being pushed or pulled. The connector link can be closed by pushing the pin in manually with no need for an additional tool; opening requires only a generally available standard implement such as any slim pointed object.

Laterally arranging the above-explained connector or, as the case may be, connector receptacle is made possible by its dimensions and locking mechanism; that arrangement moves it away from the exposed location on the housing's front end wall. The housing's front end wall which on a housing worn behind the ear is as a rule visible at least from the front can as a result be designed more freely and as being visually more pleasing. The thus gained design flexibility in terms of the housing's front end wall additionally enables the front microphone location to be provided there. The front microphone location will thus on the one hand move further away from a location that may be obscured by the ear's pinna, which will favor the registering of acoustic ambient signals. On the other hand a front microphone location that is situated further forward will also enable the rear microphone location to be moved further forward.

Both microphone locations will therefore be situated over the ear rather than behind it and can be arranged at least approximately at the same height. Arranging them at the same height will favor the registered ambient sound's spatial resolution (directionality) performed by the hearing aid's signal-processing means.

If the housing is worn behind a hearing-aid wearer's ear the plug-in connector is advantageously located on a bottom side wall of the housing—in other words on its base. The plug-in connector will in that arrangement be oriented toward the hearing-aid wearer's ear and to a very large extent will be covered by it so it will not be very exposed. The lesser exposure is on the one hand of esthetic advantage; on the other hand it can help reduce harmful environmental influences such as rain, moisture, dust, and dirt. It also enables a more reliable seal to be provided against environmental influences of such kind.

It can be seen that the described arrangement of a plug-in connector embodied as correspondingly flat or, as the case may be, having a small cross-section can be used for designing the hearing aid's housing as being overall flatter or less extensive in area in order to enhance wearing comfort and achieve an esthetically more pleasing form. The housing's front end wall that is more or less visible from the front can in particular also be designed as being flatter or less extensive in area.

A plug-in connector of such kind can as described above in particular be located on an underside of a BTE hearing aid housing so that the housing's front side and other sides can be used for other purposes, for example for locating microphones, or designed to be visually more pleasing.

Further advantageous developments will emerge from the following figures and the description:

BRIEF DESCRIPTION OF THE SEVERAL VIEWS OF THE DRAWING

FIG. 1 is a side view of a prior art hearing aid,

FIG. 2 is a side view of a hearing aid having a lateral connector and a microphone on the front end wall, FIG. 3 is a front view of a hearing aid having a lateral connector and a microphone on the front end wall.

DESCRIPTION OF THE INVENTION

Figure 4:
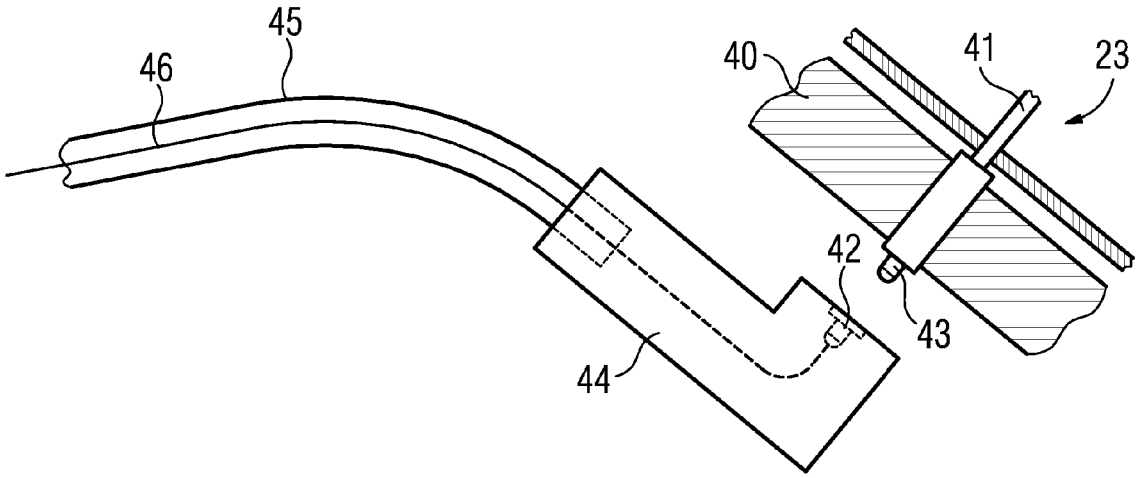
FIG. 4 shows a connector, earpiece tube, and hearing-aid housing.

FIG. 2 is a schematic side view of a hearing aid having a lateral connector 24 or, as the case may be, lateral connector receptacle 29 and a microphone 22 on the front end wall. The hearing aid comprises a housing 21 that is to be worn behind a hearing-aid wearer's ear and located in which, alongside other customarily necessary components, are microphones 22 and a plug-in connector 23 for establishing a connection to an earpiece tube 25. Plug-in connector 23 is embodied as a socket and is located in a connector receptacle 29. Earpiece tube 25 has a connector 24 that includes a plug. Connector 24 has been inserted into connector receptacle 29 provided laterally on housing 21. The plug belonging to connector 24 has therein been plugged into the socket belonging to plug-in connector 23. A receiver that is not shown but which is located on the end, also not shown, of earpiece tube 25 is electrically connected thereby by means of electric line 26 extending in earpiece tube 25.

What is indicated by the schematic is that connector 24 is inserted into connector receptacle 29 from the side of housing 21. The direction of motion when connector 24 is inserted is therefore transverse to the longitudinal direction of earpiece tube 25 in the region of connector 24 because connector 24 is situated on a longitudinal end of earpiece tube 25.

Because of the lateral arrangement of connector 24 it is possible for earpiece tube 25 likewise to be arranged laterally on housing 21 along with connector 24. Connector 24 is for that purpose of flat design compared with housing 21. Because of that arrangement, connector 24 does not obscure the front end wall of housing 21. The front end wall can therefore be put to another use and front microphone location 27 is situated there. Situated on front microphone location 27 is a microphone opening (not shown) in housing 21, to which opening one of microphones 22 is connected. Front microphone location 27 is therefore situated overall further forward on the hearing aid compared with a conventional RIC-BTE hearing aid having an earpiece-tube connector located at the front on an end face. That means that rear microphone location 28 which, so that sound detecting can undergo a spatial resolution, has to be spatially separate from the front microphone, has also overall been moved further forward on the hearing aid.

FIG. 3 is a schematic front view of a hearing aid having a lateral connector and a microphone on the front end wall. Provided in housing 31 at front microphone location 37 are microphone openings 38 to which the associated microphone (not shown) is connected. It can be seen that front microphone location 37 is situated on the front end wall of housing 31. Neither the rear microphone location nor the microphone openings are visible in the selected view.

Located on the lower side of housing 31 is a connector receptacle 39 into which earpiece tube 35 has been ducted. Neither the connector of earpiece tube 35 nor the plug connection between earpiece tube 35 and housing 31 are visible in the selected view.

It can be seen that such kind of arrangement of an earpiece-tube connector designed as correspondingly flat or, as the case may be, having a small cross-section can be used for designing housing 31 of the hearing aid as being overall flatter or less extensive in area in order to enhance wearing comfort and achieve an esthetically more pleasing form. The end wall which as a rule is visible over the ear from the front can in particular be designed as being flatter or less extensive in area.

FIG. 4 is a schematic of a plug-in connector 23 between earpiece tube 45 and the hearing-aid housing (not shown), which connector could, as described above, be used arranged laterally on a hearing-aid housing. Extending through earpiece tube 45 is an electric line 46 by means of which a receiver that is not shown but which is located on the end, also not shown, of earpiece tube 45 is connected. Connector 44 of earpiece tube 45 has a socket 42.

A plug 43 provided on the hearing-aid housing can be plugged into the socket. Plug 43 forms part of plug-in connector 23 and is located on a substrate 40. A through-connection 41 extends right through substrate 40 and connects plug 43 to electronic components (not shown) of the hearing aid, for example to an output amplifier.

It can be seen that connector 44 is plugged into or, as the case may be, onto plug-in connector 23 from below.

Figure 5:
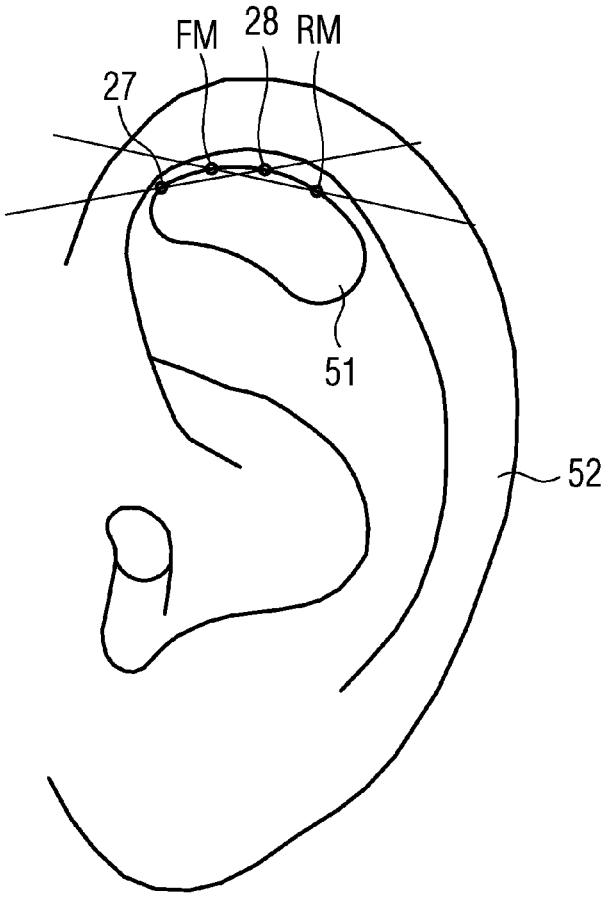
FIG. 5 is a schematic of the microphone axes on a hearing-aid wearer's ear, FIG. 6, 7, 8 are schematics of both sides of the connector.

FIG. 5 is a schematic of the microphone axes on a hearing-aid wearer's ear. Hearing aid 51 appears only in outline so that the possible microphone locations 27, 28, FM, RM can be illustrated thereupon. Of the hearing-aid wearer's ear only the contour of pinna 52 is indicated, but it does not need to be shown true to scale nor correctly as regards its orientation with respect to housing 51.

Microphone locations FM and RM identify the locations that are customary in the case of a conventional RIC-BTE hearing aid. Front microphone location FM (Front Microphone) is situated on the top side of housing 51 and with rear microphone location RM (Rear Microphone) situated further down forms a backward downsloping line—as shown in the figure. The backward downsloping line results perforce because the microphone locations have to be situated spatially apart for directionality to be possible at all and because, on the other hand, housing 51 slopes down backward from front microphone location FM to rear microphone location RM following the contour of pinna 52.

Spatially arranging microphone locations FM and RM at different heights is less favorable in terms of directionality than arranging them at the same height. It can moreover be seen that both microphone locations FM and RM are at least partially obscured by pinna 52, making it more difficult to register acoustic ambient signals. It is, though, not possible to move front microphone location FM further forward (or, consequently, the rear location, either) because in a conventional RIC-BTE hearing aid the front end wall of housing 51 is occupied by the earpiece-tube connector (not shown).

In contrast thereto, inventively arranging the earpiece-tube connector on the side wall of housing 51 will enable the front end wall or, as the case may be, front end-wall region to be put to another use. The thus created free front end wall is inventively used as the site for front microphone location 27. Front microphone location 27 is hence situated further forward on housing 51 compared with conventional front microphone location FM. Rear microphone location 28 is correspondingly also situated further forward. The two microphone locations 27 and 28 therefore form an at least approximately horizontal line—as shown in the figure. Spatially arranging microphone locations 27 and 28 at least approximately at the same height is particularly favorable in terms of directionality. It can moreover be seen that at least front microphone location 27 is relatively less obscured by pinna 52, which favors the registering of acoustic ambient signals.

Figure 6:
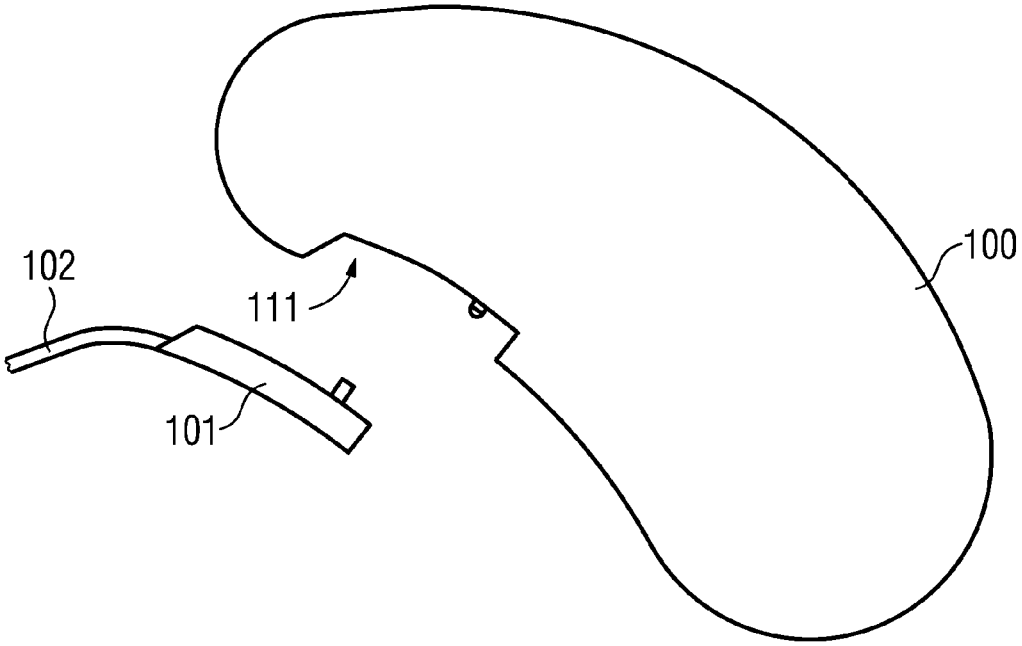

FIG. 6 is a schematic of both sides, meaning connector 101 and connector receptacle 111. A housing 100 of a hearing aid therein includes one side, namely connector receptacle 111. The other side, namely connector 101, is located on an earpiece tube 102.

Figure 7:
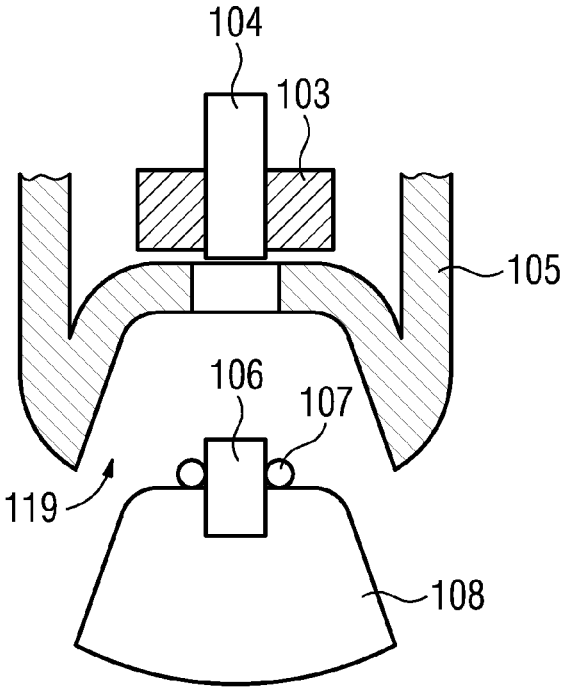

FIG. 7 is again a schematic of both sides of a connector link with connector 108 and connector receptacle 119. Connector 108 includes a contact pin 106. What is not shown in the figure is that a force elastically driving it out of plug 108 can have been applied to contact pin 106; it can accordingly be embodied as a pogo pin, for instance. Arranged around contact pin 106 is sealing ring 107 that can be embodied as an O ring, for example. Sealing ring 107 has been arranged such as to form a seal against the ingress of moisture, water, dirt, and suchlike along the path via the electric plug connection when said connection has been closed.

Located in connector receptacle 119 is an opening through which contact pin 107 can be inserted into a contact-pin receptacle 104. The electric contact between connector receptacle 119 or, as the case may be, the hearing aid and connector 108 will be closed thereby. Contact-pin receptacle 104 is therein attached to inner frame 103 of the hearing aid; it can form a constituent part of other electric components attached to inner frame 103.

Figure 8:
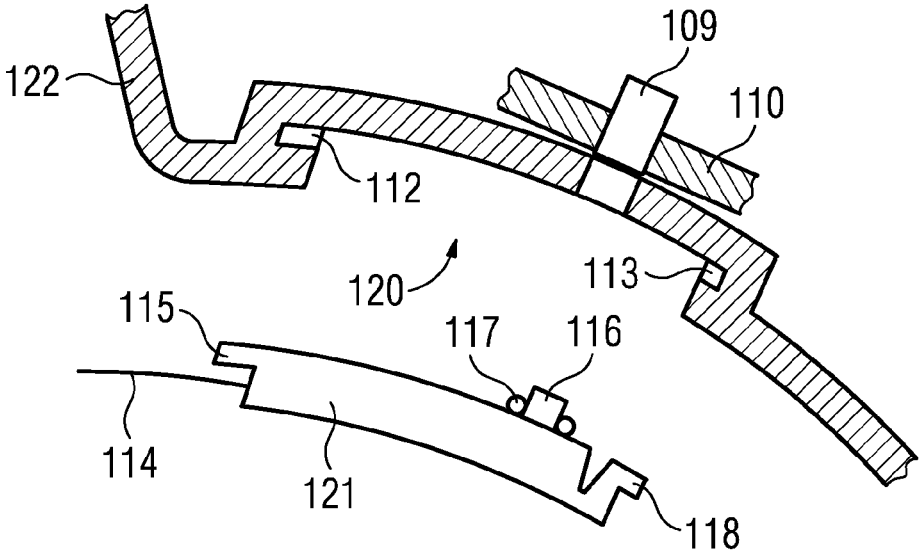

FIG. 8 is a schematic of both sides of a connector link with connector 121 and connector receptacle 120. Connector 121 is located on an earpiece tube 114. It has a contact pin 116 surrounded by a sealing ring 117. It further comprises a rigid retaining collar 115 and a flexible deadbolt 118; the deadbolt can have been molded onto plug 121 as a single piece therewith; it can be made of flexible plastic, for example.

Connector receptacle 120 is located on a housing 122 and includes an opening through which contact pin 116 can be inserted into a contact-pin receptacle 109. Contact-pin receptacle 109 is mounted on an inner frame 110 possibly together with or as a constituent part of other electric components. Contact pin 116 and contact-pin receptacle 109 jointly form the plug connection's electric connecting component. It can be seen that the electric connecting component comprises plug 121 and inner frame 110 or, as the case may be, components attached to inner frame 110.

Connector receptacle 120 has undercuts 112, 113 that can be brought into mutual engagement with retaining collar 115 or, as the case may be, deadbolt 118 of connector 121. Connector 121 is for that purpose first inserted by means of retaining collar 115 into undercut 112 assigned to retaining collar 115. Elastic deadbolt 118 is then brought into mutual engagement with undercut 113 assigned to it by rotationally moving connector 121 around the rotational axis formed by undercut 112 and retaining collar 115. Retaining collar 115, deadbolt 118, and assigned undercuts 112 and 113 jointly form the plug connection's mechanical connecting component. It can be seen that the mechanical connecting component comprises connector 121 and housing 122.

Undercut 113 and deadbolt 118 can be shaped such as to render separate actuating of deadbolt 118 unnecessary; it instead snaps into undercut 113 automatically when connector 121 is pressed in. That does not require a separate tool. To open the connector link, deadbolt 118 must be actuated such as to be released from undercut 113 so that connector 121 can be pulled out; depending on the specific embodiment, that may require the use of a narrow tool such as a screwdriver to be able to reach into the gap between deadbolt 118 and the housing part forming undercut 113.

Figure 9:
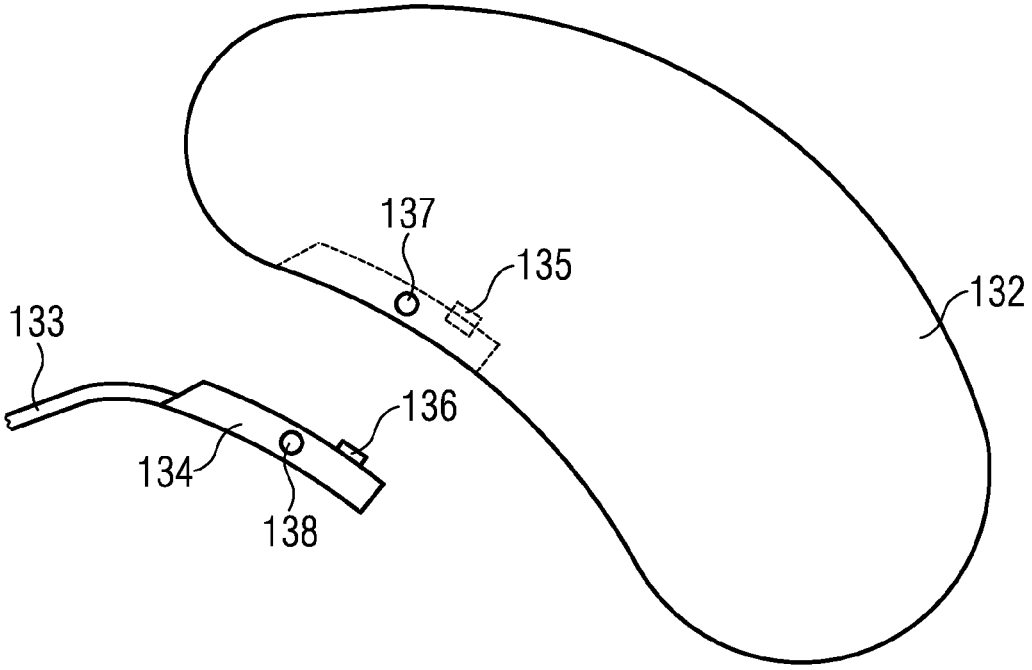
FIG. 9 shows a hearing aid with a connector.

FIG. 9 is a schematic of a hearing aid having a lateral connector receptacle or, as the case may be, a lateral connector 134. The hearing aid comprises a housing 132 provided in which is a locking-pin receptacle 137. Locking-pin receptacle 137 is embodied as a round opening. In the connector receptacle an electric plug-in connector 135 mounted inside housing 132 on inner frame 139 can be accessed through an opening.

Connector 134 is located on the longitudinal end of an earpiece tube 133. It likewise comprises a locking-pin receptacle 138 embodied likewise as a round opening. Connector 134 furthermore has an electric plug-in connector 136.

Connector 134 is inserted laterally into the housing's convector receptacle by means of a movement that is transverse to the longitudinal direction of earpiece tube 133. The electric connection from connector 134 into the interior of housing 132 is therein closed by electric plug-in connectors 135, 136. Locking-pin receptacles 137, 138 are moreover brought into congruent positions situated one above the other and the mechanical connection from connector 134 to housing 132 is closed by pushing a locking pin (not shown in the figure) through. The locking pin has a cross-section that is the same as or smaller than that of locking-pin receptacles 137, 138 to the extent that it can be pushed through them but cannot spontaneously slip out of them. To open the connector link the locking pin has to be removed from locking-pin receptacles 137, 138 by being pulled or pushed.

A basic idea of the invention can be summarized thus: The invention relates to a connector for a hearing instrument, in particular an RIC-BTE hearing aid. The object of the invention is to disclose a small and visually inconspicuous connector for a hearing instrument, the aim being for the connector to be as little visible as possible or even not at all on the hearing instrument when being worn, and which connector will make a microphone arrangement possible that is favorable for directionality and sound registering when used on a BTE hearing aid. A connector 24, 44, 101, 108, 121, 134 on an earpiece tube 25, 35, 45, 102, 114, 133 is disclosed for that purpose, with a longitudinal direction being defined in the region of connector 24, 44, 101, 108, 121, 134 by earpiece tube 25, 35, 45, 102, 114, 133 and with connector 24, 44, 101, 108, 121, 134 being connected transversely to the longitudinal direction by being inserted into a connector receptacle 29, 39, 111, 119, 120 of a hearing instrument. Further disclosed is a hearing instrument, in particular an RIC-BTE hearing aid, having a laterally arranged connector receptacle 29, 39, 111, 119, 120 into which a connector 24, 44, 101, 108, 121, 134 is inserted transversely to the longitudinal direction of the hearing aid. Because it is plugged in transversely to the longitudinal direction, the connector can be arranged laterally on the housing. The lateral arrangement enables the housing's front end wall to be of smaller design and the housing hence overall of flatter design. Instead of the connector a microphone can furthermore be arranged on the end wall, which is advantageous in terms of sound registering and directionality.

The invention claimed is:

1. A hearing instrument, comprising:

a housing configured for placement behind an ear of a user and being generally shaped with a convex upper side, a concave lower side, a forward-facing front wall, and defining a longitudinal housing direction;

said housing having a connector receptacle formed in said concave lower side and an electric connecting element inside said connector receptacle of said housing;

a connector disposed on an earpiece sound tube and configured for interconnecting the earpiece sound tube with the housing of the hearing instrument;

said connector having an electric connecting component configured for connecting in mutual engagement with said electric connecting element inside said connector receptacle and a mechanical connecting component configured for placement into mechanical engagement with said connector receptacle;

wherein said earpiece sound tube connects to the connector along the longitudinal axis and the connector is formed for insertion into said connector receptacle in a direction transverse to the longitudinal axis, and wherein said connector is received in said connector receptacle flush with said lower concave side of said housing and said earpiece sound tube is ducted into said connector receptacle into said concave lower side of said housing; and said housing having at least one microphone opening formed in the forward-facing front wall.

2. The hearing instrument according to claim 1, wherein the hearing instrument is an RIC-BTE hearing aid and said housing is formed with a further microphone opening in said convex upper side, and wherein said at least one microphone opening formed in said forward-facing front wall and said microphone opening formed in said convex upper side are arranged substantially at an equal height when the hearing aid is worn behind the ear.

3. The hearing instrument according to claim 1, wherein said mechanical connecting component is formed with undercuts on said housing, and said undercuts are configured to be brought into mutual engagement with a retaining collar and an elastic deadbolt of said connector.

4. The hearing instrument according to claim 1, wherein said mechanical connecting component comprises a locking-pin receptacle on said housing, said receptacle being oriented such that said connector can be locked by inserting a locking pin into said locking-pin receptacle and unlocked by removing said locking pin.

5. The hearing instrument according to claim 1, wherein the hearing instrument is a behind-the-ear BTE hearing aid and said earpiece sound tube connects said BTE hearing aid to a receiver to be placed in the ear canal of a hearing aid wearer.

6. The hearing instrument according to claim 1, wherein said mechanical connecting component includes a sealing means.

7. The hearing instrument according to claim 1, wherein said mechanical connecting component includes a sealing ring.

8. The hearing instrument according to claim 1, wherein said mechanical connecting component comprises a retaining collar and an elastic deadbolt, both to be brought into mutual engagement with an undercut of the housing of the hearing instrument.

9. The hearing instrument according to claim 1, wherein said mechanical connecting component comprises a locking-pin receptacle which is oriented such that the connector can be locked by inserting a locking pin into the locking-pin receptacle and unlocked by removing the locking pin.

10. The hearing instrument according to claim 1, wherein said electric connecting component comprises a contact pin to which an elastic force is applied.

11. The hearing instrument according to claim 10, wherein said contact pin is a pogo pin.

* * * * *